US011974614B2

(12) United States Patent
Ly et al.

(10) Patent No.: US 11,974,614 B2
(45) Date of Patent: May 7, 2024

(54) SHIRT WITH CONVERTIBLE COLLAR

(71) Applicant: 5.11, Inc., Manteca, CA (US)

(72) Inventors: John Thiet Ly, Tustin, CA (US); Dana Dean Belshe, Huntington Beach, CA (US); Jodie Lynn Udzenija, Tustin, CA (US)

(73) Assignee: 5.11, Inc., Manteca, CA (US)

( * ) Notice: Subject to any disclaimer, the term of this patent is extended or adjusted under 35 U.S.C. 154(b) by 0 days.

(21) Appl. No.: 17/950,026

(22) Filed: Sep. 21, 2022

(65) Prior Publication Data

US 2023/0117706 A1 Apr. 20, 2023

Related U.S. Application Data

(60) Provisional application No. 63/246,887, filed on Sep. 22, 2021.

(51) Int. Cl.
*A41B 3/00* (2006.01)

(52) U.S. Cl.
CPC ..... *A41B 3/00* (2013.01)

(58) Field of Classification Search
CPC .. A41B 3/00; A41B 3/005; A41B 3/02; A41B 3/04; A41B 1/12; A41B 1/16; A41B 3/06; A41B 3/08; A41B 3/12; A41B 3/14; A41B 3/16; A41B 5/00; A41D 27/18
USPC ..... 2/131, 143
See application file for complete search history.

(56) References Cited

U.S. PATENT DOCUMENTS

| | | | | | |
|---|---|---|---|---|---|
| 253,750 | A * | 2/1882 | Norton | A41B 3/00 | 2/129 |
| 367,460 | A * | 8/1887 | Struensee | A41B 3/00 | 2/129 |
| 844,795 | A * | 2/1907 | Hart | A41B 3/00 | D2/602 |
| 872,914 | A * | 12/1907 | Eaton | A41B 3/00 | 2/116 |
| 1,186,700 | A * | 6/1916 | Spence | A41B 3/02 | 2/141.1 |
| 1,613,653 | A * | 1/1927 | Goetting | A41B 3/00 | 2/129 |
| 1,975,205 | A * | 10/1934 | Frankfurther | A41B 3/00 | 2/143 |
| 2,099,520 | A * | 11/1937 | Hendryey | A41B 3/00 | 2/131 |
| 2022/0232914 | A1* | 7/2022 | Kim | A41D 27/18 | |
| 2023/0035991 | A1* | 2/2023 | Roup | A41B 3/06 | |

FOREIGN PATENT DOCUMENTS

| | | | |
|---|---|---|---|
| DE | 1435888 | A1 * | 2/1992 |
| FR | 724782 | A * | 5/1932 |
| GB | 341387 | A * | 1/1931 |
| GB | 342139 | A * | 1/1931 |
| GB | 411437 | A * | 6/1934 |

* cited by examiner

*Primary Examiner* — Amy Vanatta
(74) *Attorney, Agent, or Firm* — Knobbe, Martens, Olson & Bear, LLP

(57) ABSTRACT

A shirt having a shirt body and a collar connected to the shirt body. The collar is convertible between at least a straight collar orientation and a mandarin orientation. The collar has a first end and a second end each having a slit. The slit allows a portion of each of the first end and the second end of the outer collar portion to fold to a turned under position relative to a base portion of the outer collar portion in the straight collar orientation.

12 Claims, 3 Drawing Sheets

SHIRT WITH CONVERTIBLE COLLAR

RELATED APPLICATIONS

This application claims the benefit under 35 U.S.C. § 119(e) of U.S. Patent Application Ser. No. 63/246,887, entitled "SHIRT WITH CONVERTIBLE COLLAR" and filed on Sep. 22, 2021, which is hereby incorporated by reference in its entirety. In addition, any and all applications for which a foreign or domestic priority claim is identified in the application data sheet as filed with the present application are also expressly incorporated by reference.

BACKGROUND

Field

The present disclosure relates to garments. In particular, the present disclosure relates to an upper body garment with a convertible collar.

Description of Related Art

Garments with convertible collars exist. However, a need still exists for a garment, such as a shirt, having a convertible collar that provides improved functionality and/or appearance relative to the prior art, or at least provides the purchasing public with a useful choice.

SUMMARY

The systems, methods and devices described herein have innovative aspects, no single one of which is indispensable or solely responsible for their desirable attributes. Without limiting the scope of the claims, some of the advantageous features will now be summarized.

An aspect of the present disclosure involves a shirt having a shirt body and a collar connected to the shirt body. The collar is convertible between at least a straight collar orientation and a mandarin orientation. The collar has a first end and a second end each having a slit. The slit allows a portion of each of the first end and the second end of the outer collar portion to fold to a turned under position relative to a base portion of the outer collar portion in the straight collar orientation.

In some configurations, a fastener on each of the first end and the second end is configured to secure the respective portion of the first end and the second end to a base portion of the collar in the turned under position.

In some configurations, the fastener comprises a button and slit, a snap connector, or a hook and loop fastener.

In some configurations, each of the slits defines a terminal end located on a roll line between a stand portion and an outer collar portion of the collar.

An aspect of the present disclosure involves a shirt having a shirt body and a collar connected to the shirt body. The collar has a first end and a second end. The collar includes a stand portion having a neckline edge located toward the shirt body. The collar also includes an outer collar portion having a collar edge located away from the shirt body. The outer collar portion is connected to the stand portion. A roll line is located between the stand portion and the outer collar portion. Each of the first end and the second end defines an unconnected length between the stand portion and the outer collar portion, which allows a folding portion of each of the first end and the second end of the outer collar portion to fold to a turned under position relative to a base portion of the outer collar portion along a first fold line and a second fold line, respectively, to form a straight collar orientation of the collar.

In some configurations, a fastener on each of the first end and the second end is configured to secure the folding portion to the base portion of the outer collar portion in the turned under position.

In some configurations, the fastener comprises a button and slit, a snap connector, or a hook and loop fastener.

In some configurations, each of the unconnected lengths defines a terminal end located on the roll line.

In some configurations, a first fastener portion is located on the folding portion of the first end and a second fastener portion is located on the folding portion of the second end. The first fastener portion and the second fastener portion are connectable to one another with the outer collar portion in an upstanding position such that the collar can be secured in a mandarin orientation.

In some configurations, a third fastener portion is located on the base portion adjacent the folding portion of the first end and a fourth fastener portion is located on the base portion adjacent the folding portion of the second end. The first fastener portion is connectable to the third fastener portion and the second fastener portion is connectable to the fourth fastener portion such that each of the folding portions can be secured in the turned under position.

In some configurations, the first fastener and the second fastener comprises a button and slit, a snap connector, or a hook and loop fastener.

In some configurations, the first fastener, the second fastener, the third fastener and the fourth fastener comprises a button and slit, a snap connector, or a hook and loop fastener.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are not to be considered limiting of its scope, the disclosure will be described with additional specificity and detail through the use of the accompanying drawings.

DETAILED DESCRIPTION

Figure 1:
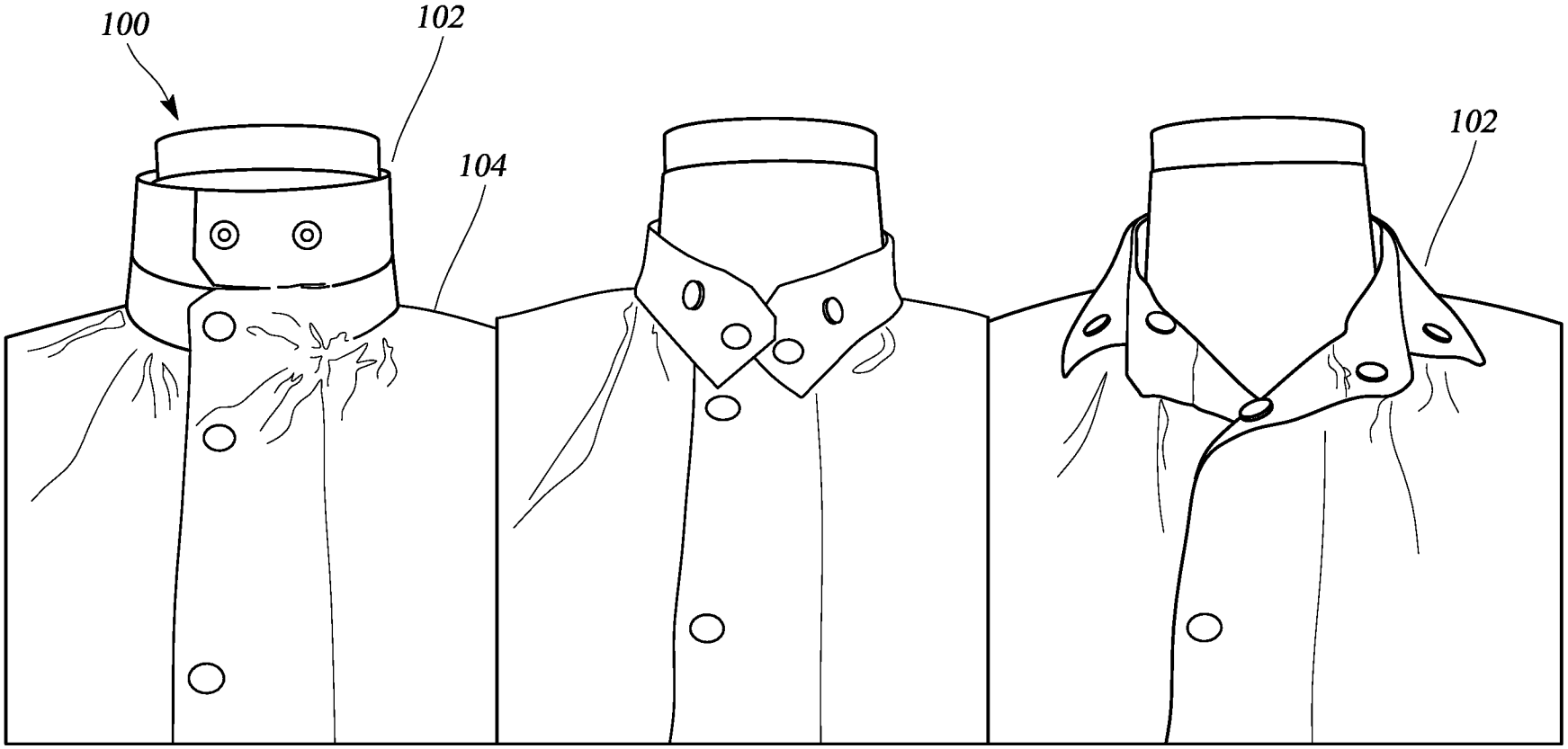
FIG. 1 is a front view of a garment having a convertible collar shown in a mandarin orientation, a straight collar orientation and an intermediate orientation.

Embodiments of the garment and methods of assembly and manufacture will now be described with reference to the accompanying Figures, wherein like numerals refer to like or similar elements throughout. Although several embodiments, examples and illustrations are disclosed below, it will be understood by those of ordinary skill in the art that the inventions described herein extends beyond the specifically disclosed embodiments, examples and illustrations, and can include other uses of the inventions and obvious modifications and equivalents thereof. The terminology used in the description presented herein is not intended to be interpreted in any limited or restrictive manner simply because it is being used in conjunction with a detailed description of certain specific embodiments of the inventions. In addition, embodiments of the inventions can comprise several novel features and no single feature is solely responsible for its desirable attributes or is essential to practicing the inventions herein described.

Certain terminology may be used in the following description for the purpose of reference only, and thus are not intended to be limiting. For example, terms such as "above" and "below" refer to directions in the drawings to which reference is made. Terms such as "front," "back," "left," "right," "rear," and "side" describe the orientation and/or location of portions of the components or elements within a consistent but arbitrary frame of reference which is made clear by reference to the text and the associated drawings describing the components or elements under discussion. Moreover, terms such as "first," "second," "third," and so on may be used to describe separate components. Such terminology may include the words specifically mentioned above, derivatives thereof, and words of similar import.

FIGS. 1-5 illustrate a garment 100, which is an upper body garment or shirt in the illustrated configuration. However, in other configurations, the garment could be another type of garment, such as outerwear. Furthermore, the illustrated garment is of an open front type, which can be closed by way of a snap, button, zipper or other suitable closure. However, in other configurations, the garment can be a pullover type.

The illustrated shirt 100 includes a convertible collar 102 connected to a shirt body 104 of the shirt 100. The collar 102 is convertible between at least a first orientation and a second orientation. In the illustrated arrangement, the collar 102 is convertible between a straight collar orientation (shown on the right of FIG. 1) and a mandarin orientation (shown on the left of FIG. 1). The middle view of FIG. 1 shows the collar 102 in an intermediate orientation between the straight collar orientation and the mandarin orientation. The collar 102 can be configured for wearing in the intermediate orientation or the intermediate orientation can merely be a temporary position between the straight collar orientation and the mandarin orientation.

Figure 3:
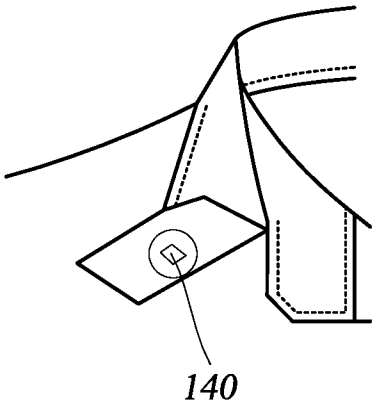
FIG. 3 illustrates an underneath surface of one of the folding portions of FIG. 2 to show a fastener portion that allows the folding portion to be secured to a base portion of the collar.
Figure 2:
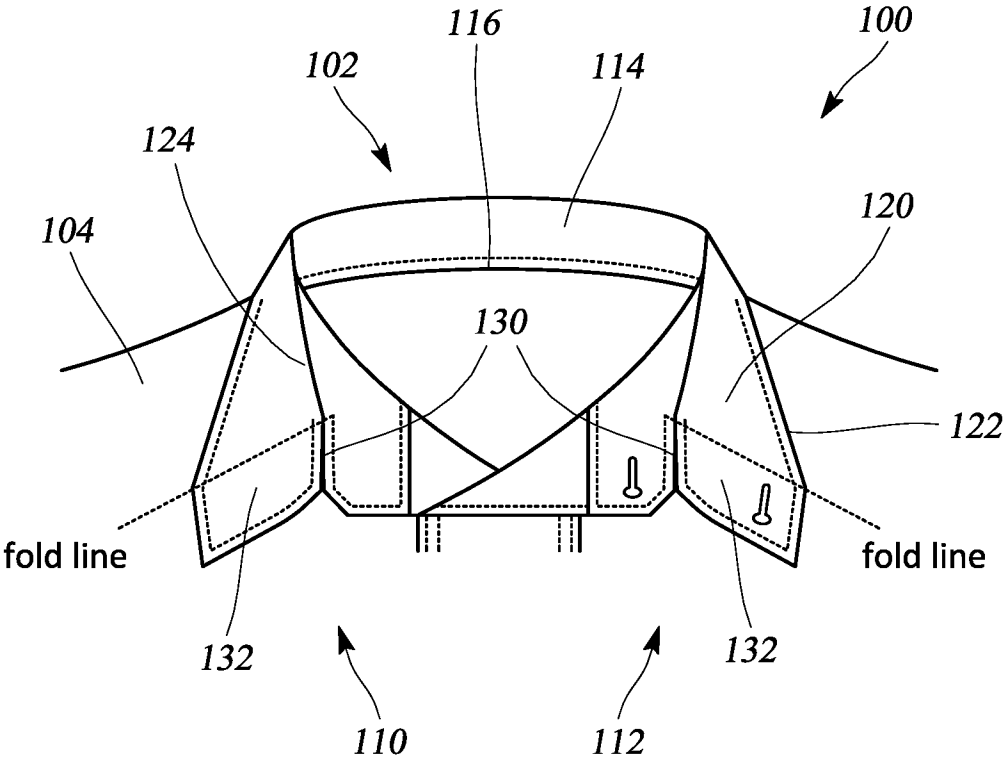
FIG. 2 is a front view of a garment similar to that of FIG. 1 showing folding portions of the ends of the collar.
Figure 4:
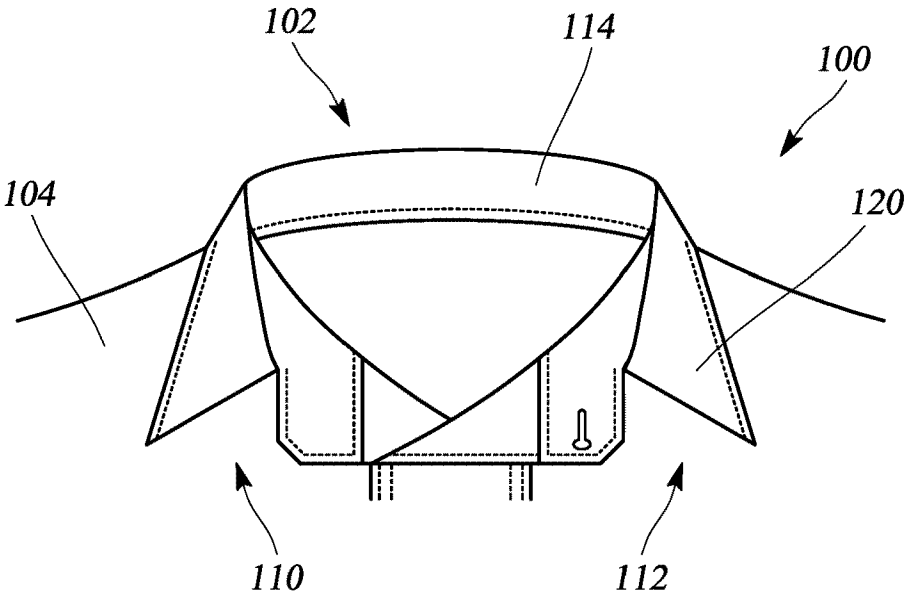
FIG. 4 illustrates the garment of FIG. 2 with the collar in a straight collar orientation.

With reference to FIGS. 2 and 3, the collar 102 is formed by a band having a first end 110 and a second end 112 located on opposite sides of the front of the shirt 100. The collar 102 includes a stand portion 114 having a neckline edge 116 located toward the shirt body 104. The collar 102 also includes an outer collar portion 120 having a collar edge 122 located away from the shirt body 104. The outer collar portion 120 is connected to the stand portion 114. A roll line 124 is located between the stand portion 114 and the outer collar portion 120 and, in the illustrated configuration, defines a transition between the stand portion 114 and the outer collar portion 120.

Each of the first end 110 and the second end 112 of the collar 102 defines an unconnected length 130 between the stand portion 114 and the outer collar portion 120. In the illustrated configuration, the unconnected length 130 is in the form of a slit 130. The illustrated slit 130 is linear or straight; however, other configurations could use a curved or non-straight slit 130. In the illustrated configuration, each of the unconnected lengths 130 or slits 130 defines a terminal end located on the roll line 124 between the stand portion 114 and the outer collar portion 120 of the collar 102.

The slit 130 or unconnected length 130 is configured to allow a folding portion 132 of each of the first end 110 and the second end 112 of the outer collar portion 120 to fold to a turned under position (see FIG. 4) relative to a base portion of the outer collar portion 120 along a first fold line and a second fold line, respectively. When the folding portions 132 are moved to the turned under position, a straight collar orientation of the collar 102 is formed.

In some configurations, a fastener 140 on each of the folding portions 132 of the first end 110 and the second end 112, respectively, is configured to secure the respective folding portion 132 to a base portion of the collar 102 in the turned under position. A first portion of the fastener 140 can be located on the folding portion 132 and a second portion of the fastener 140 can be located on the base portion of the collar 102. The first and second portions can be configured to be selectively fastened to one another. In the illustrated arrangement, the folding portion 132 of the first end 110 includes a button and the base portion of the first end 110 includes a complementary slit or buttonhole, which can be formed in a tab or additional material layer such that the slit does not pass entirely through the outer collar portion 120. Similarly, the folding portion 132 of the second end 112 includes a slit or buttonhole (that does pass through the outer collar portion 120) and the base portion of the second end 112 includes a complementary button.

Figure 5:
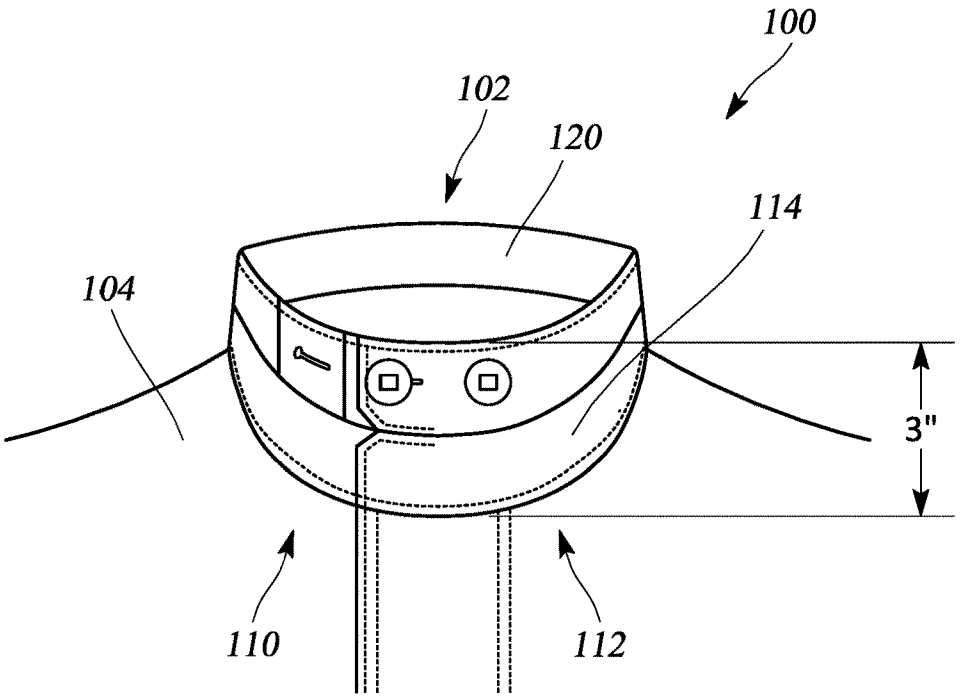
FIG. 5 illustrates the garment of FIG. 2 with the collar in a mandarin orientation.

As discussed above, the collar 102 is configured to be secured in a mandarin configuration. In the illustrated configuration, the button of the folding portion 132 of the first end 110 can be secured to the slit or buttonhole of the folding portion 132 of the second end 112 with the folding portions 132 unfolded and the outer collar portion 120 in an upstanding position to secure the collar 102 in the mandarin orientation, as shown in FIG. 5. The collar 102 can have a desired height in the mandarin orientation, such as about 2-4 inches, or about 3 inches, for example.

In some configurations, the stand portion 114 of the collar 102 can also include a fastener configured to secure the first end 110 of the collar 102 to the second end 112 of the collar 102. In the illustrated arrangement, the fasteners are button and slit or buttonhole fasteners. However, other suitable fasteners could also be used, such as a snap button connector, a hook and loop fastener, or a magnetic fastener.

Conclusion

It should be emphasized that many variations and modifications may be made to the herein-described embodiments, the elements of which are to be understood as being among other acceptable examples. All such modifications and variations are intended to be included herein within the scope of this disclosure and protected by the following claims. Moreover, any of the steps described herein can be performed simultaneously or in an order different from the steps as ordered herein. Moreover, as should be apparent, the features and attributes of the specific embodiments disclosed herein may be combined in different ways to form additional embodiments, all of which fall within the scope of the present disclosure.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Moreover, the following terminology may have been used herein. The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" or "approximately" means that quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but should also be interpreted to also include individual values and sub-ranges within the indicated range. Thus, included in this numerical range are individual values such as 2, 3 and 4 and sub-ranges such as "about 1 to about 3," "about 2 to about 4" and "about 3 to about 5," "1 to 3," "2 to 4," "3 to 5," etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

What is claimed is:

1. A shirt, comprising:

a shirt body;

a collar connected to the shirt body, the collar having a first end and a second end, the collar comprising:

a stand portion comprising a neckline edge located toward the shirt body;

an outer collar portion comprising a collar edge located away from the shirt body, the outer collar portion connected to the stand portion, wherein a roll line is located between the stand portion and the outer collar portion;

a first slit at the first end;

a second slit at the second end;

a first fold line at the first end; and a second fold line at the second end;

wherein each of the first slit and the second slit defines an unconnected length between the stand portion and the outer collar portion;

wherein the unconnected length of the outer collar comprises a folding portion of each of the first end and the second end of the outer collar portion;

wherein the folding portion folds to a turned under position relative to a base portion of the outer collar portion along the first fold line and the second fold line, respectively, to form a straight collar orientation of the collar.

2. The shirt of claim 1, further comprising a fastener on each of the folding portions, the fastener configured to secure the folding portion to the base portion of the outer collar portion in the turned under position.

3. The shirt of claim 2, wherein the fastener comprises a button and slit, a snap connector, or a hook and loop fastener.

4. The shirt of claim 1, wherein each of the unconnected lengths defines a terminal end located on the roll line.

5. The shirt of claim 1, further comprising a first fastener portion located on the folding portion of the first end and a second fastener portion located on the folding portion of the second end, wherein the first fastener portion and the second fastener portion are connectable to one another with the outer collar portion in an upstanding position such that the collar can be secured in a mandarin orientation.

6. The shirt of claim 5, further comprising a third fastener portion located on the base portion adjacent the folding portion of the first end and a fourth fastener portion located on the base portion adjacent the folding portion of the second end, wherein the first fastener portion is connectable to the third fastener portion and the second fastener portion is connectable to the fourth fastener portion such that each of the folding portions can be secured in the turned under position.

7. The shirt of claim 6, wherein the first fastener portion, the second fastener portion, the third fastener portion and the fourth fastener portion comprises a button and slit, a snap connector, or a hook and loop fastener.

8. The shirt of claim 5, wherein the first fastener portion and the second fastener portion comprises a button and slit, a snap connector, or a hook and loop fastener.

9. A shirt, comprising:

a shirt body;

a collar connected to the shirt body, the collar convertible between at least a straight collar orientation and a mandarin orientation, the collar having a first end and a second end each having a slit and a fold line, which allows a portion of each of the first end and the second end of an outer collar portion to fold along the fold line to a turned under position relative to a base portion of the outer collar portion in the straight collar orientation.

10. The shirt of claim 9, further comprising a fastener on each of the first end and the second end configured to secure the respective portion of the first end and the second end to a base portion of the collar in the turned under position.

11. The shirt of claim 10, wherein the fastener comprises a button and slit, a snap connector, or a hook and loop fastener.

12. The shirt of claim 11, wherein each of the slits defines a terminal end located on a roll line between a stand portion and an outer collar portion of the collar.

* * * * *